US008911062B2

(12) United States Patent
Kuwata et al.

(10) Patent No.: US 8,911,062 B2
(45) Date of Patent: Dec. 16, 2014

(54) LIQUID-JET HEAD AND IMAGE FORMING APPARATUS

(71) Applicants: Masahiro Kuwata, Kanagawa (JP); Kunihiro Yamanaka, Kanagawa (JP); Satoru Tobita, Kanagawa (JP)

(72) Inventors: Masahiro Kuwata, Kanagawa (JP); Kunihiro Yamanaka, Kanagawa (JP); Satoru Tobita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/782,113

(22) Filed: Mar. 1, 2013

(65) Prior Publication Data

US 2013/0242001 A1 Sep. 19, 2013

(30) Foreign Application Priority Data

Mar. 19, 2012 (JP) ..... 2012-061640

(51) Int. Cl.
*B41J 2/04* (2006.01)
*B41J 2/045* (2006.01)
*B41J 2/14* (2006.01)

(52) U.S. Cl.
CPC ..... *B41J 2/045* (2013.01); *B41J 2/14274* (2013.01); *B41J 2202/11* (2013.01)
USPC ..... 347/54; 347/68; 347/72

(58) Field of Classification Search
USPC ..... 347/68, 72
See application file for complete search history.

(56) References Cited

U.S. PATENT DOCUMENTS

| | | | | |
|---|---|---|---|---|
| 6,557,985 | B2 | 5/2003 | Hosono et al. | |
| 6,568,794 | B2 | 5/2003 | Yamanaka et al. | |
| 8,197,048 | B2 | 6/2012 | Yamanaka et al. | |
| 8,348,407 | B2 | 1/2013 | Matsufuji et al. | |
| 2006/0098058 | A1 * | 5/2006 | Yazaki | 347/72 |
| 2011/0057992 | A1 | 3/2011 | Tobita et al. | |
| 2012/0069093 | A1 | 3/2012 | Kuwata et al. | |

FOREIGN PATENT DOCUMENTS

| | | |
|---|---|---|
| JP | 3454218 | 10/2003 |
| JP | 2004-209921 | 7/2004 |

OTHER PUBLICATIONS

U.S. Appl. No. 13/619,016, filed Sep. 14, 2012, Kuwata.
U.S. Appl. No. 13/615,331, filed Sep. 13, 2012, Kuwata.

* cited by examiner

*Primary Examiner* — Lisa M Solomon
(74) *Attorney, Agent, or Firm* — Cooper & Dunham LLP

(57) ABSTRACT

A liquid-jet head includes a channel plate forming an individual liquid chamber in communication with nozzles configured to eject liquid drops, a wall surface member forming a wall surface of the individual liquid chamber, and a drive unit disposed on the wall surface member side and configured to generate a pressure applied to a drive region inside the individual liquid chamber. In the liquid-jet head, a fluid resistance part is formed by disposing an island part in a liquid supply channel configured to supply a liquid to the individual liquid channel, and the island part includes a gradient part on the channel plate side, at least a part of the gradient part being formed such that the part of the gradient part faces the drive region inside the individual liquid chamber.

12 Claims, 11 Drawing Sheets

LIQUID-JET HEAD AND IMAGE FORMING APPARATUS

BACKGROUND OF THE INVENTION

1. Field of the Invention

The disclosures herein relate to a liquid-jet head and an image forming apparatus.

2. Description of the Related Art

An inkjet recording apparatus is generally known as an example of a liquid-jet recording type image forming apparatus, such as a printer, a facsimile machine, or a plotter, or a multifunctional peripheral having a combination of these functions. The inkjet recording apparatus includes a recording head formed of a liquid-jet head (liquid-drop jet head) ejecting liquid drops.

Japanese Laid-open Patent Publication No. 2004-209921 (hereinafter referred to as "Patent Document 1") discloses an example of the liquid-jet head including an individual liquid chamber in communication with nozzles ejecting liquid drops, and a common liquid chamber supplying a liquid to the individual liquid chamber via a liquid supply channel having a fluid resistance part.

RELATED ART DOCUMENTS

Patent Document

Patent Document 1: Japanese Laid-open Patent Publication No. 2004-209921

It is preferable that the individual liquid chamber be reduced in size for improving a drive frequency of the liquid-jet head. In such a case, layered components forming the individual liquid chamber need to be thinner. Thinning the channel plate that forms the individual liquid chamber may thin a wall part of a surface of the channel plate that faces a drive unit of the individual liquid chamber. As a result, the channel plate may become susceptible to deformation due to pressure from the drive unit.

When the wall part of the surface facing the drive unit of the individual liquid chamber is deformed, pressure generated in the drive unit will not be efficiently applied to the liquid inside the individual liquid chamber, or pressure fluctuation properties inside the individual liquid chamber will be changed. Hence, stable ejecting properties will not be secured.

Accordingly, it is a general object of at least one embodiment of the present invention to provide a liquid-jet head and an image forming apparatus having such a liquid-jet head capable of reducing in size of the head while stabilizing the ejecting properties, which substantially eliminate one or more problems caused by the limitations and disadvantages of the related art.

SUMMARY OF THE INVENTION

In one embodiment, there is provided a liquid-jet head that includes a channel plate forming an individual liquid chamber in communication with nozzles configured to eject liquid drops; a wall surface member forming a wall surface of the individual liquid chamber; and a drive unit disposed on the wall surface member side and configured to generate a pressure applied to a drive region inside the individual liquid chamber. In the liquid-jet head, a fluid resistance part is formed by disposing an island part in a liquid supply channel configured to supply a liquid to the individual liquid channel, and the island part includes a gradient part on the channel plate side, at least a part of the gradient part being formed such that the part of the gradient part of the gradient part faces the drive region inside the individual liquid chamber.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Preferred embodiments are described below, with reference to the accompanying drawings.

Figure 1:
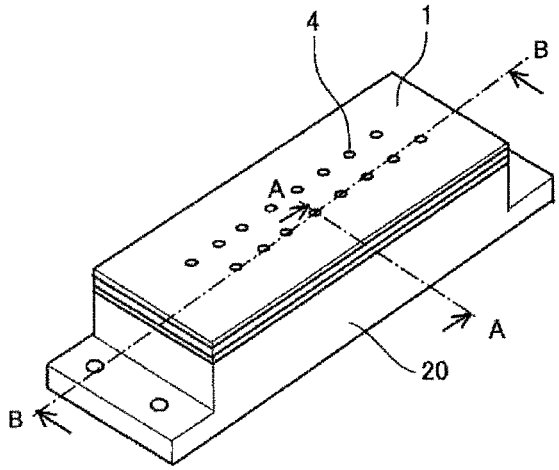
FIG. 1 is an external perspective diagram illustrating a liquid-jet head according to a first embodiment.
Figure 2:
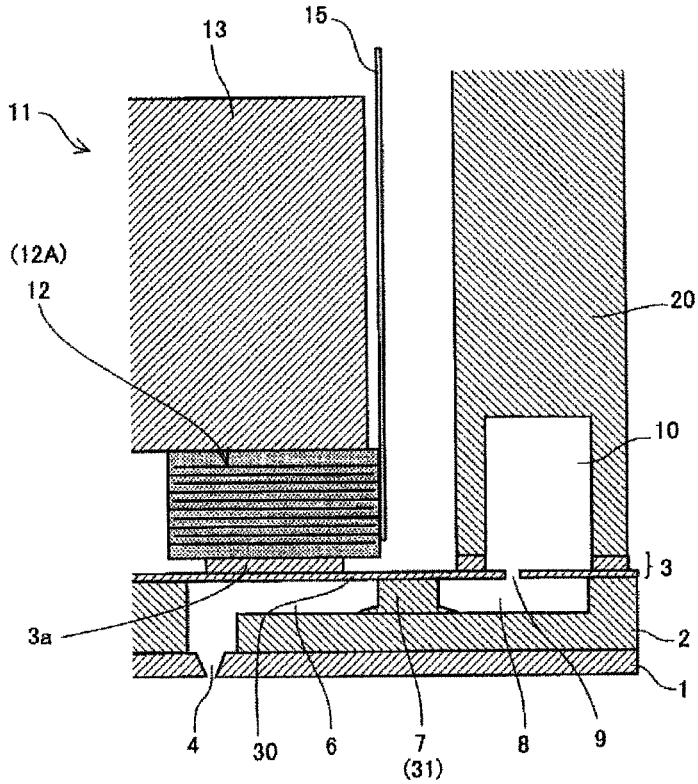
FIG. 2 is a cross-sectional diagram illustrating the liquid-jet head in a direction orthogonal to a nozzle array direction (a liquid chamber longitudinal direction) taken along an A-A line in FIG. 1.
Figure 3:
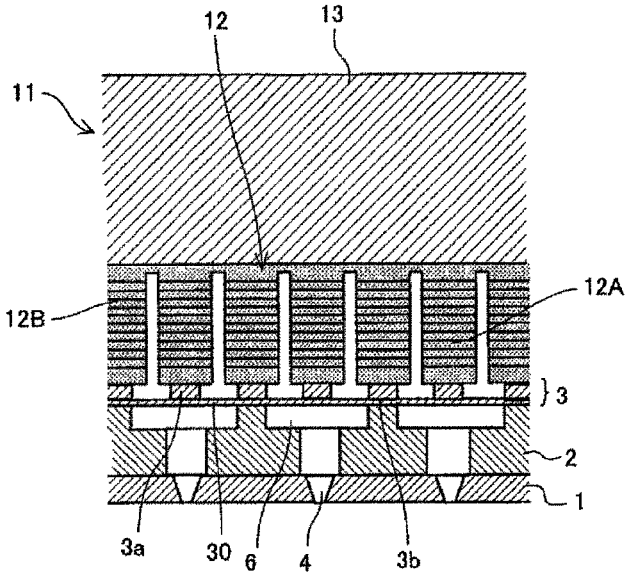
FIG. 3 is a cross-sectional diagram illustrating the liquid-jet head in a direction orthogonal to a nozzle array direction (a liquid chamber short direction) taken along a B-B line in FIG. 1.

Preferred embodiments are described below, with reference to the accompanying drawings. First, a liquid-jet head according to a first embodiment is described with reference to FIGS. 1 to 4. Note that FIG. 1 is an external perspective diagram illustrating a liquid-jet head according to a first embodiment, FIG. 2 is a cross-sectional diagram illustrating the liquid-jet head in a direction orthogonal to a nozzle array direction (a liquid chamber longitudinal direction) taken along an A-A line in FIG. 1, and FIG. 3 is a cross-sectional diagram illustrating the liquid-jet head in a direction orthogonal to a nozzle array direction (a liquid chamber short direction) taken along a B-B line in FIG. 1.

The liquid-jet head according to the first embodiment includes a nozzle plate 1, a channel plate (a liquid chamber substrate) 2, and a diaphragm member 3 serving as a wall surface member that are bonded in a layered manner. The liquid-jet head according to the first embodiment further includes an actuator 11 configured to displace the diaphragm member 3, and a frame member 20 serving as a common channel member.

In the liquid-jet head according to the first embodiment, the nozzle plate 1, the channel plate 2, and the diaphragm member 3 form, as individual channels, individual liquid chambers (may also be called "pressurizing liquid chambers", "pressure chambers", "pressurizing chambers", and "channels") 6 in communication with respective nozzles 4 configured to eject liquid drops, a liquid supply channel 7 configured to supply a liquid to the individual liquid chamber 6 and serving as a fluid resistance part, and a liquid introducing part 8 communicating with the liquid supply channel 7.

Accordingly, the liquid-jet head according to the first embodiment supplies a liquid to the plural individual chambers 6 from a common liquid chamber 10 serving as a common channel of the frame member 20 through an opening 9 formed in the diaphragm member 3, the liquid introducing part 8, and the liquid supply channel V.

Note that the nozzle plate 1 is formed of a metallic plate made of nickel (Ni), which is produced by electroforming. The nozzle plate 1 is not limited to that formed of the metallic plate made of nickel (Ni), but may be formed of other types of the metallic plate, a resin member, a layered member of a resin layer and a metallic layer, etc. The nozzle plate 1 may include the nozzles 4 having a diameter of 10 to 35 μm corresponding to the respective individual liquid chambers 6, and may be bonded to the channel plate 2 with an adhesive. Further, a water repellent layer is formed on a liquid drop ejecting surface (i.e., a surface in an ejecting direction: an ejecting surface, or a surface opposite to the liquid chamber 6 side) of the nozzle plate 1.

The channel plate 2 includes grooves forming the individual liquid chambers 6, the liquid supply channel 7 including a fluid resistance part, and the liquid introducing part 8, which are formed by etching a monocrystalline silicon substrate. Note that the channel plate 2 may be formed by etching a metallic plate such as a SUS substrate with an acid etching liquid, or may be formed by machining such as press working.

The diaphragm member 3 includes a deformable oscillating region 30 corresponding to the individual liquid chamber 6. The deformable oscillating region 30 serves as a wall surface member forming a wall surface of the individual liquid chamber 6 of the channel plate 2.

The piezoelectric actuator 11 is disposed on a side opposite to the individual liquid chambers 6 of the diaphragm member 3, and includes an electromechanical transducer element serving as a driving part (i.e., an actuator part, and a pressure generating part) configured to deform the oscillating region 30 of the diaphragm member 3.

The piezoelectric actuator 11 includes plural layered piezoelectric members 12 bonded on a base members 13 with an adhesive, and desired numbers of column-shaped piezoelectric devices (i.e., piezoelectric columns) 12A and 12B, in which grooves are formed by half-cut dicing, are formed in a pectinate configuration at predetermined intervals corresponding to one of the layered piezoelectric members 12.

The piezoelectric columns 12A and 12B of the piezoelectric member 12 are formed as the same elements. However, the piezoelectric columns 12A and 12B are differentiated as the piezoelectric column 12A serving as a driven pressure column (or a driven column) configured to be driven by being supplied with a driving waveform, and the piezoelectric column 12B serving as a non-driven pressure column (or a non-driven column) utilized as a supporting column configured not to be supplied with a driving waveform to be driven.

The driven column 12A is bonded to an island-shaped projection part 3*a* formed in the oscillating region 30 of the diaphragm member 3. Further, the non-driven column (i.e., the piezoelectric column 12B) is bonded to a projection part 3*b* of the diaphragm member 3.

The piezoelectric member 12 includes alternate layers of piezoelectric layers and internal electrodes, and external electrodes are formed by drawing the internal electrodes to end faces to which a FPC 15 for supplying driving signals to the external electrodes of the piezoelectric member 12 serving as a flexible printed wiring board is connected.

The frame member 20 may, for example, be made of epoxy resin or thermoplastic resin such as polyphenylene sulfide, which is produced by injection molding. The frame member 20 includes the common liquid chamber 10 to which a liquid is supplied from not-illustrated head tanks or liquid cartridges.

In the inkjet head having the above configuration, the potential applied to the driven column 12A is lowered from a reference potential to cause the driven column 12A to contract, which lowers an oscillating region 30 of the diaphragm member 3 and expands the volume of the individual liquid chamber 6. As a result, the liquid flows into the individual liquid chamber 6 to raise the potential applied to the driven column 12A, which causes the driven column 12A to extend in a stacked direction. This deforms the oscillating region 30 of the diaphragm member 3 toward the nozzle 4 direction to cause the volume of the individual liquid chamber 6 to contract so that the liquid inside the individual liquid chamber 6 is pressurized to thereby eject (jet) liquid drops from the nozzles 4.

When the voltage applied to the driven column 12A returns to the reference potential to restore the oscillating region 30 of the diaphragm member 3 to an initial position, the individual liquid chamber 6 expands to generate a negative pressure. As a result, the liquid is supplied into the individual liquid chamber 6 via the liquid supply channel 7 from the common liquid chamber 10. When the oscillations of meniscus in the nozzles 4 are damped and stabilized, the liquid-jet head is moved for a next operation.

Note that a method for driving the liquid-jet head is not limited to the above example, but the liquid-jet head may be driven by applying the driving waveform to the piezoelectric column 12A in different ways so as to cause the piezoelectric column 12A to contract or expand.

Figure 4:
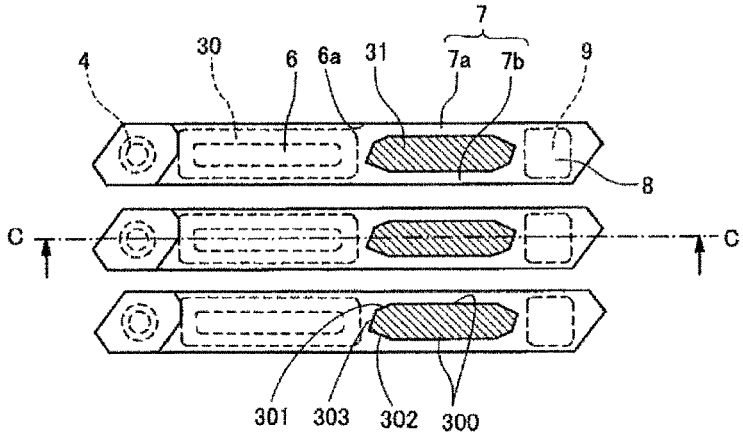
FIG. 4 is a plan diagram illustrating a channel part of the liquid-jet head according to the first embodiment.
Figure 5:
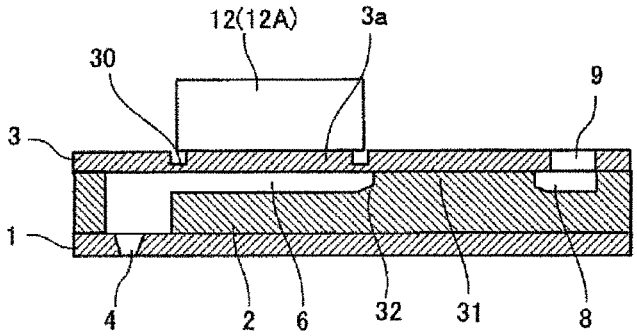
FIG. 5 is a side-sectional diagram of the liquid-jet head taken along a C-C line in FIG. 4.
Figure 6:
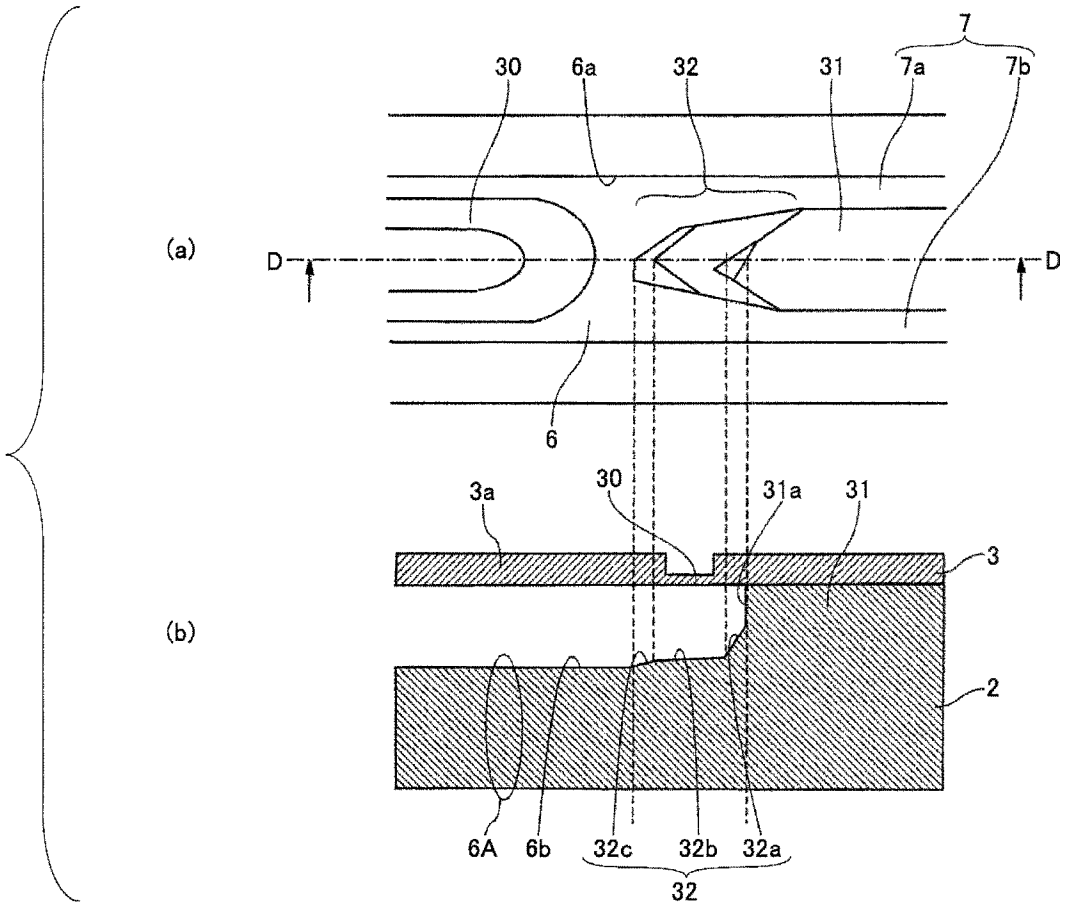
FIG. 6 is a diagram illustrating an end part of an island part, in which (a) is an enlarged plan diagram illustrating the end part of the island part, and (b) is a side-sectional diagram taken along a D-D line of (a)

Next, the first embodiment is described with reference to FIGS. 4 to 6. FIG. 4 is a plan diagram illustrating a channel part of the liquid-jet head according to the first embodiment, FIG. 5 is a side-sectional diagram of the liquid-jet head taken along a C-C line in FIG. 4, and FIG. 6 is a diagram illustrating an end part of an island part, in which (a) is an enlarged plan diagram illustrating the end part of the island part, and (b) is a side-sectional diagram taken along a D-D line of (a).

In a groove 6*a* forming the individual liquid chamber 6, the liquid supply channel 7, and a liquid introducing part 8 of the channel plate 2, an island part (i.e., an island projection part)

31 is formed in a region of the liquid supply channel 7, so as to form two fluid resistance parts 7*a* and 7*b*.

Further, a gradient part 32 is formed at least at an end part on the individual liquid chamber 6 side in a liquid flowing direction of the island part 31 on the channel plate 2 side (i.e., a bottom surface of a groove part 6*a*; i.e., a facing surface 6*b* side of the individual liquid chamber 6 facing the diaphragm member 3). The gradient part 32 is illustrated as a slope in this embodiment; however, the gradient part 32 may be formed of plural descending vertical steps. In this case, the following "slope" of the gradient part 32 indicates a slope connecting between edges of the steps projected toward the individual liquid chamber side.

The gradient part 32 is configured to face the oscillating region 30 of a thin layer (i.e., a diaphragm part) of the diaphragm member 3 serving as a driving region. The gradient part 32 is also configured to face a part of the oscillating region 30 and the projection part 3*a* serving as a coupling part with the driven column 12A of the diaphragm member 3 in this embodiment.

In this case, even if a thickness of a top surface 6A including a facing surface 6*b* of the individual liquid chamber 6 facing the driven column 12A is reduced in a state where the liquid inside the individual liquid chamber 6 is pressurized by driving the driven column 12A of the piezoelectric member 12, a thickness of an end part of the top surface 6A, of the individual liquid chamber 6 is increased, and thus reinforced in the gradient part 32. As a result, the top surface 6A of the individual liquid chamber 6 may be suppressed from deforming due to pressure. Thus, stable liquid ejecting properties may be obtained.

In this case, when a reinforced region faces the oscillating region 30, the deformation suppression effect may be exhibited. However, it is preferable that the reinforced region face the projection part 3*a* with which the deformation of the piezoelectric column 12A is directly communicated in order to further improve the deformation suppression effect.

Further, a liquid volume of the individual liquid chamber may be reduced in an amount corresponding to a volume of the gradient part compared to an example without having the gradient part. When the liquid volume of the individual liquid chamber is reduced, a liquid chamber resonance period may be shortened corresponding to the reduction in the liquid volume of the individual liquid chamber. Accordingly, a drive frequency of the liquid-jet head in proportion to the liquid chamber resonance may be increased.

Further, as illustrated in FIG. 6, in a central part of the end part of the island part 31 in a direction orthogonal to a liquid flowing direction, the gradient part 32 includes a slope surface 32*a* obliquely rising toward the facing surface 6*b* from a wall surface 31*a* on the diaphragm member 3 side of the island part 31, an intermediate surface 32*b* approximately parallel to the facing surface 6*b* continuing from the slope surface 32*a*, and a slope surface 32*c* rising to the facing surface 6*b* continuing from the intermediate surface 32*b*. Note that the "rising" direction is specified when the nozzles 4 of the liquid-jet head are disposed downward.

As described above, since the gradient part 32 includes the slope surfaces, liquid flowing inside the individual liquid chamber 6 may be improved further than a case where the gradient part 32 is formed of the plural vertical steps.

Note that as noted above, it is preferable that the "slope" of the gradient part 32 include at least two-phase gradients. If the "slope" is composed of a one-phase gradient, a volume of the gradient part 32 inside the individual liquid chamber 6 may be increased. Consequently, it may be difficult to secure a sufficiently large volume of the individual liquid chamber 6. By contrast, if the "slope" of the gradient part 32 is composed of the two-phase gradients, apart of the gradient part 32 on the fluid resistant part side is formed of a steep slope, and a part of the gradient part 32 entering into the individual liquid chamber 6 is formed of a gradual slope. With this configuration, even if a large area of the individual liquid chamber 6 is reinforced, an adverse effect on the volume of the individual liquid chamber 6 may be suppressed.

Note that in this embodiment, the channel plate 2 is formed of a silicon substrate. Thus, the end part of the island part 31 in the liquid flowing direction includes a (1 1 1) crystal orientation 300, first and second crystal orientations 301 and 302 continuing into and in contact with the (1 1 1) crystal orientation 300, a third crystal orientation 303 differing from the (1 1 1) crystal orientation 300 continuing into and in contact with the first and the second crystal orientations 301 and 302. Note that the third crystal orientation 303 may be a (1 1 1) crystal orientation insofar as the third crystal orientation 303 differs from the (1 1 1) crystal orientation 300.

In such a case, the third crystal orientation 303 is obliquely formed in the liquid flowing direction with respect to the individual liquid chamber 6. Since the third crystal orientation 303 is obliquely formed, a cavity region due to a liquid flow may be reduced, which may facilitate flowing of the liquid. Accordingly, stable liquid drop ejection may be achieved. Further, air bubble eliminating properties may be improved by obliquely forming the third crystal orientation 303 to reduce the cavity region.

Figure 7:
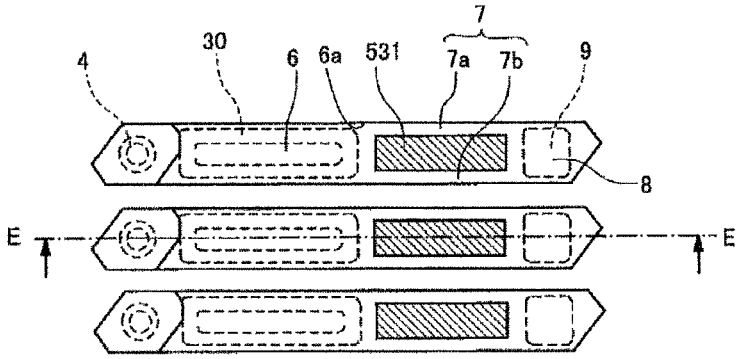
FIG. 7 is plan diagram illustrating a channel part of a liquid-jet head according to a comparative example.
Figure 8:
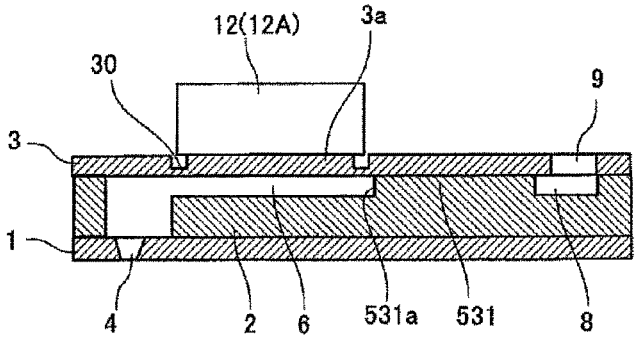
FIG. 8 is a side-sectional diagram of the liquid-jet head according to the comparative example taken along an E-E line in FIG. 7.

Note that a comparative example is illustrated with reference to FIGS. 7 and 8. FIG. 7 is plan diagram illustrating a channel part of a liquid-jet head according to a comparative example, and FIG. 8 is a side-sectional diagram of the liquid-jet head according to the comparative example taken along an E-E line in FIG. 7.

According to the comparative example, an island part 531 in a plan view has a rectangular shape, and a wall surface 531*a* of an end part of the island part 531 in a liquid flowing direction is formed as a vertical call with respect to a facing surface 6*b* of the individual liquid chamber 6.

With this configuration, when a thickness of a top surface 6A including the facing surface 6*b* of the individual liquid chamber 6 facing the driven column 12A is reduced in a state where the liquid inside the individual liquid chamber 6 is pressurized by driving the driven column 12A of the piezoelectric member 12, the top surface 6A is deformed due to the applied pressure. Thus, stable liquid ejecting properties may fail to be obtained. Further, a connecting part between the vertical wall 531*a* and the top surface 6A may be cracked and hence damaged due to repeated driving operations.

In addition, a cavity region in the end part of the island part 531 in the liquid flowing direction may be increased, which may inhibit the flowing of the liquid, and which may further lower air bubble eliminating properties.

Next, a method for fabricating the channel plate according to the first embodiment is described further with reference to FIGS. 9A to 9D. FIGS. 9A to 9D are plan diagrams each illustrating the island part in fabricating the channel plate of the liquid-jet head according to the first embodiment. In FIGS. 9A to 9D, a broken line indicates a pattern and a solid line indicates a silicon substrate.

Figure 9A:
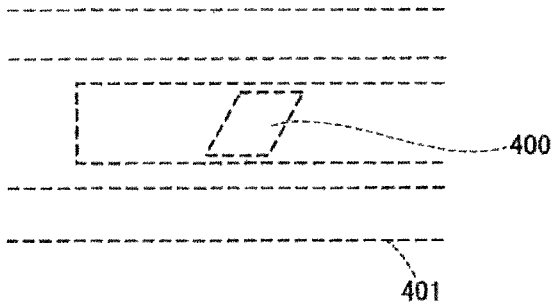
FIGS. 9A to 9D are plan diagrams each illustrating the island part in fabricating the channel plate of the liquid-jet head according to the first embodiment.

First, a protection pattern 401 is formed on a (1 1 0) silicon substrate with resist as illustrated in FIG. 9A. Note that a compensation pattern 400 having a surface forming the third crystal orientation 303 of the island part 31 is disposed on a part in which the island part 31 is formed.

Note that the compensation pattern 400 is a trench opening having a rhombus shape, four sides of which are enclosed by a (1 1 1) crystal orientation; however, the compensation pattern 400 may be formed in an any shape. Further, one face of the compensation pattern 400 is formed in parallel with a surface serving as the third crystal orientation 303 of the island part 31 after etching; however, the face of the compensation pattern 400 may be formed in parallel with any surface of the island part 31.

Figure 9B:
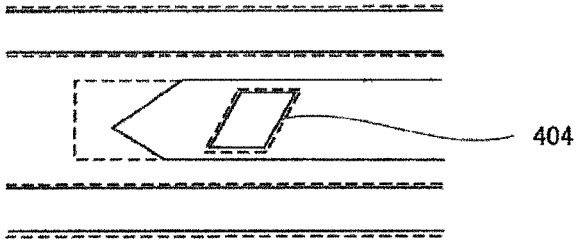

Subsequently, the silicon substrate protected by the protection pattern 401 is etched by immersing the silicon substrate into etchant. Accordingly, an opening part 404 of the protection pattern 401 is etched as illustrated in FIG. 9B. Further, since an etching rate at a pointed end of the island part is rapid, a bottom surface of the protection pattern 401 is gradually etched.

Further, since the rhombus trench opening serving as the compensation pattern 400 formed on the protection pattern 401 is not protected and hence etched so as to form a crystal face serving as the third crystal orientation 303 after etching.

Note that when the (1 1 1) face is formed in an inverted pyramid shape, the etching rate may become extremely slow, and etching of the trench opening may be almost stopped. Accordingly, the trench opening is not etched deeper than a phase sufficiently shallower than a depth of the channel.

Subsequently, when the etching is further progressed, the etching of the bottom surface of the protection pattern 401 is further progressed. Hence, a surface obtained by etching the bottom surface of the protection pattern 401 from the end part of the island part may meet an etched surface of the trench opening.

Figure 9C:
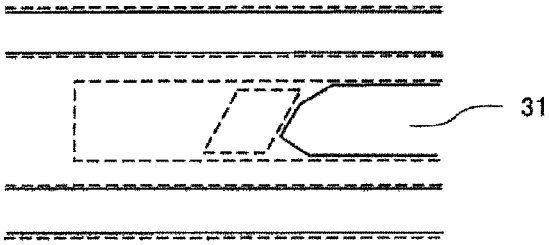

Further, as illustrated in FIG. 9C, the first crystal orientation 301 and the second crystal orientation 302 formed by the progress of etching the bottom surface of the protection pattern 401, and the third crystal orientation 303 formed of the trench opening are formed in the island part 31.

Figure 9D:
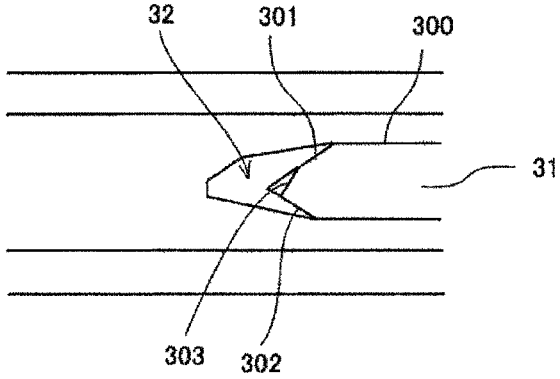

Thereafter, as illustrated in FIG. 9D, the channel plate that includes the island part (island projection part) 31 formed of the end part having the first crystal orientation 301 and the second crystal orientation 302, and the third crystal orientation 303 disposed such that the third crystal orientation 303 presses the pointed end formed by the first crystal orientation 301 and the second crystal orientation 302 may be obtained by stripping off the protection pattern 401.

At this moment, the gradient part 32 composed of etching residues is formed such that the gradient part 32 is removed from a bottom part of the island part 31 in a depth direction of the island part 31 (i.e., the facing surface 6*b* side of the individual liquid chamber).

Figure 10A:
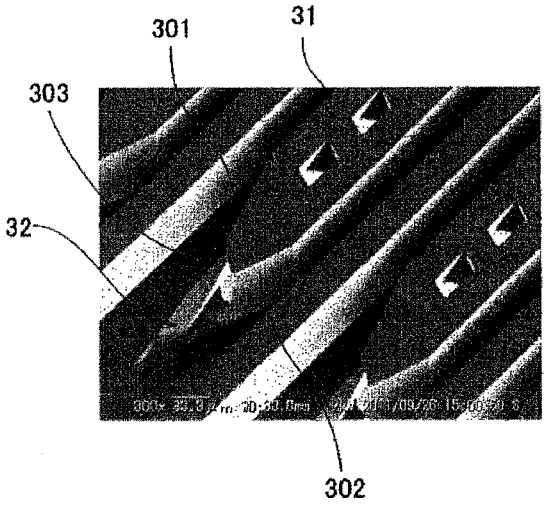
FIGS. 10A and 10B are scanning electron microscope (SEM) photographs depicting an end part of the island part formed by the above method.
Figure 10B:
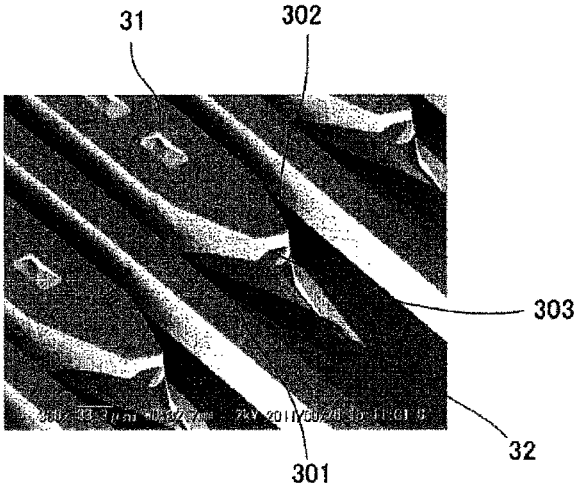

FIGS. 10A and 10B are scanning electron microscope (SEM) photographs depicting the end part of the island part 31 formed by the above method. As illustrated in FIGS. 10A and 10B, the island part 31 includes the first crystal orientation 301, the second crystal orientation 302, and the third crystal orientation 303 formed such that the third crystal orientation 303 presses the pointed end formed by the first crystal orientation 301 and the second crystal orientation 302.

Figure 11:
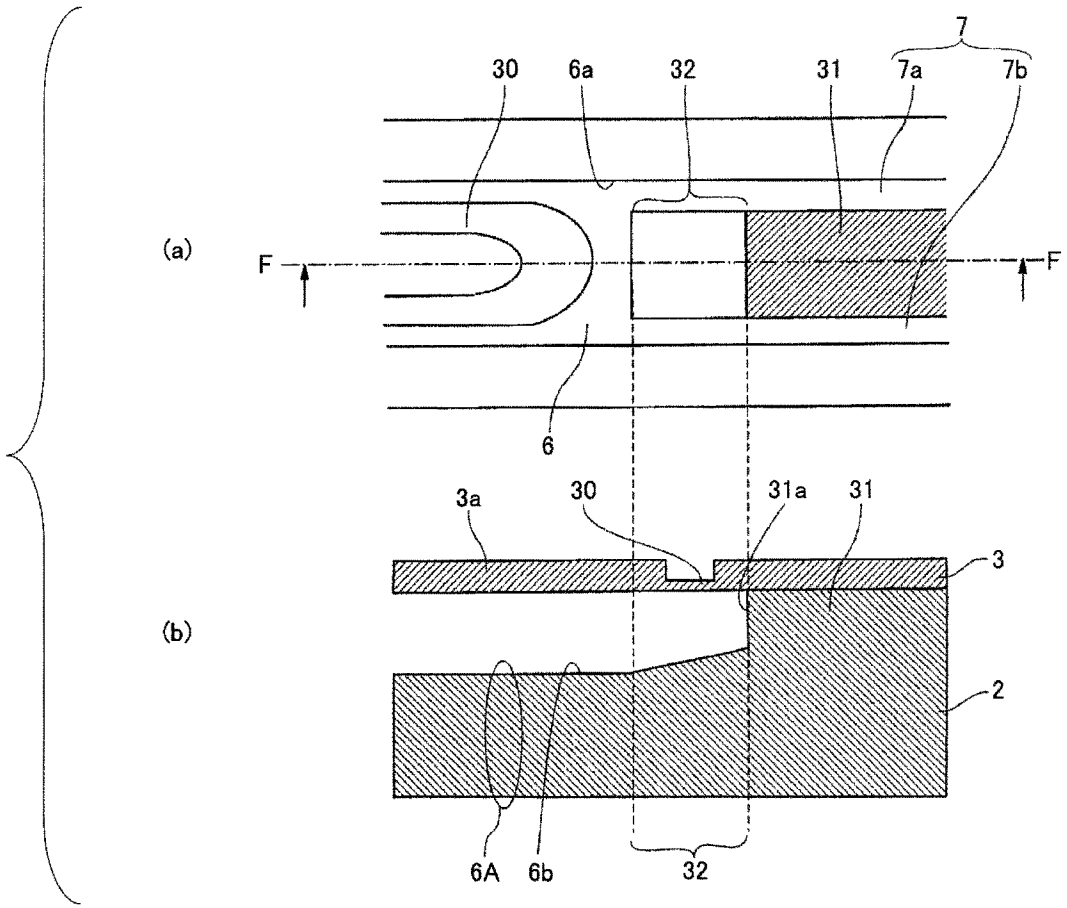
FIG. 11 is a diagram illustrating an end part of an island part according to a second embodiment, in which (a) is an enlarged plan diagram illustrating the end part of the island part, and (b) is a side-sectional diagram taken along an F-F line of (a)

Next, a liquid-jet head according to a second embodiment is described with reference to FIG. 11. FIG. 11 is a diagram illustrating an end part of an island part according to the second embodiment, in which (a) is an enlarged plan diagram illustrating the end part of the island part, and (b) is a side-sectional diagram taken along an F-F line of (a).

In the second embodiment, the gradient part 32 of the island part 31 is formed of a slope surface obliquely rising from a wall surface 31*a* of the island part 31 toward the facing surface it of the individual liquid chamber 6.

With this configuration, advantageous effects similar to those of the first embodiment may be obtained.

Note that in the above embodiment, the island part forming the fluid resistance parts are integrally formed on the channel plate side. However, the island part may be integrally formed on the diaphragm member (i.e., the wall surface member) side. Further, an example utilizing a piezoelectric element (i.e., an electromechanical transducer element) as the drive unit is illustrated in the above embodiment. However, a thermal type actuator utilizing a heat element or an electrostatic type actuator utilizing the diaphragm and a counter electrode may also be applied.

Further, in the above embodiment, an example of the top plate of the channel plate, the island part, and the gradient part being integrally formed is described. However, the top plate of the channel plate, the island part, and the gradient part may be separately formed, and subsequently bonded with an adhesive in a layered manner.

Figure 12:
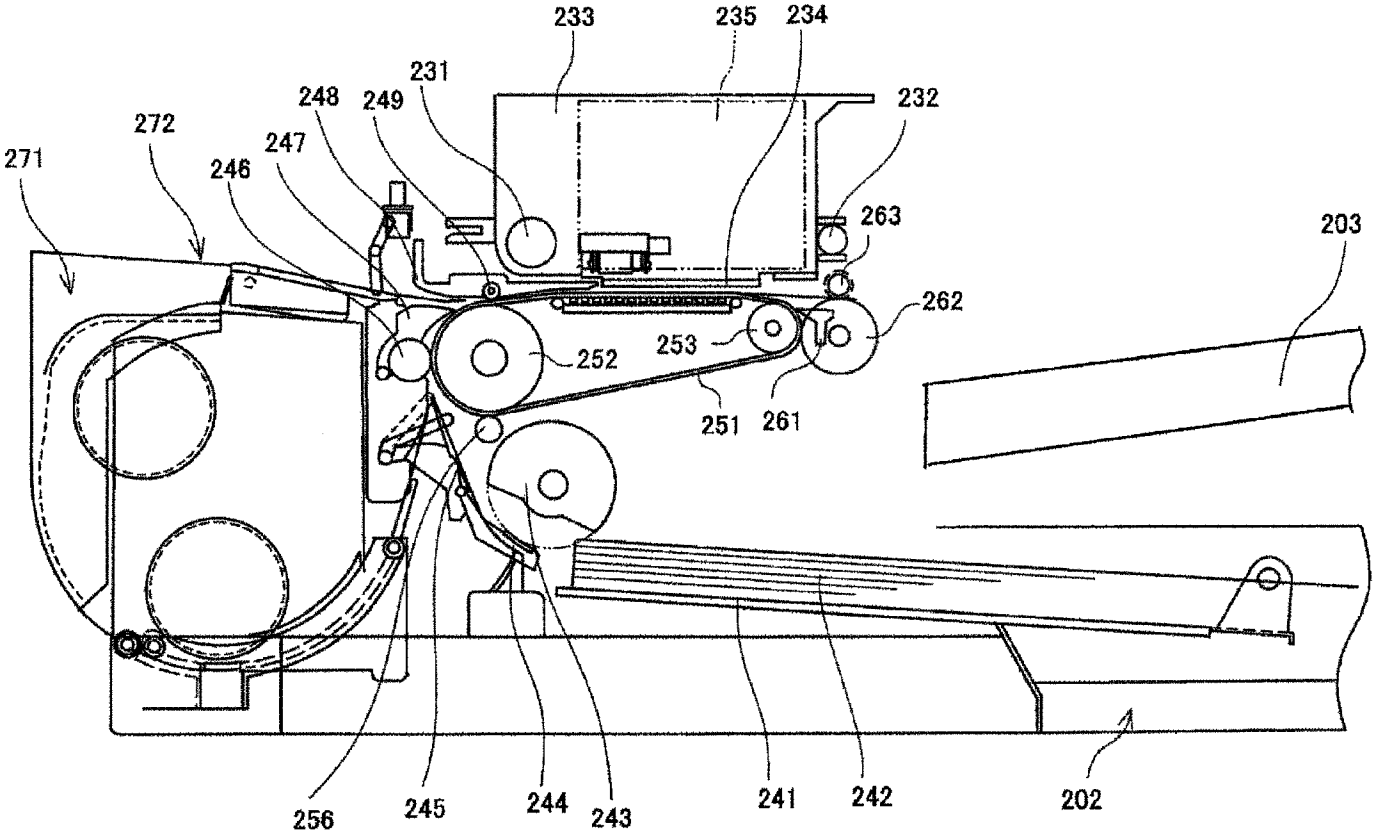
FIG. 12 is a side diagram illustrating an example of a mechanical part of an image forming apparatus having the liquid-jet head according to one of the embodiments.
Figure 13:
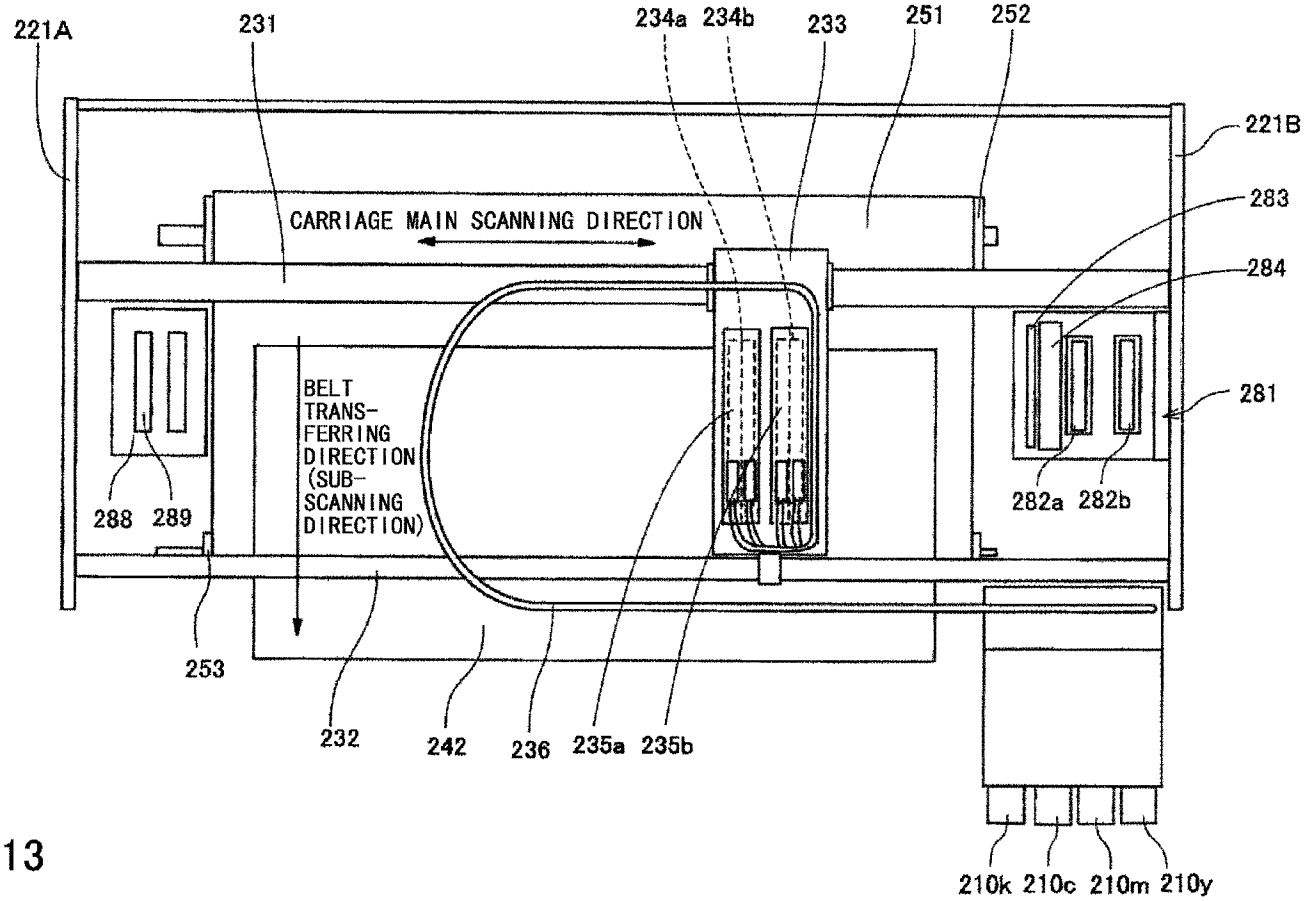
FIG. 13 is a plan diagram illustrating a main part of the mechanical part.

Next, an example of an image forming apparatus having a liquid-jet head according to an embodiment is described with reference to FIGS. 12 and 13. Note that FIG. 12 is a side diagram illustrating an example of a mechanical part of an image forming apparatus having the liquid-jet head according to the embodiments, and FIG. 13 is a plan diagram illustrating a main part of the mechanical part.

The image forming apparatus is a serial-type image forming apparatus. The serial-type image forming apparatus includes a carriage 233 that is slidably supported in main-scanning directions by a driving guide rod 231 and a driven guide rod 232 serving as guide members bridging between left-side and right-side plates 221A and 221B, and that is moved while scanning via a timing belt in arrow directions (carriage main-scanning directions) by a not-shown main-scanning motor.

The carriage 233 includes a recording head 234 integrally having liquid-jet heads having nozzles respectively ejecting ink drops of yellow (Y), cyan (C), magenta (M), and black (K), and ink tanks containing ink to be supplied to the respective liquid-jet heads. In the recording head 234 integrally having the liquid-jet heads and the respective ink tanks, a nozzle array formed of the nozzles held by the recording head 234 is disposed in a sub-scanning directions orthogonal to the main-scanning direction, and ink ejecting directions of the nozzles are downward.

The recording head 234 includes first and second recording heads 234*a* and 234*b*. Each of the recording heads 234*a* and 234*b* has two nozzle arrays. One of the nozzle arrays of the first recording head 234*a* is configured to eject black (K) liquid drops, and the other nozzle array of the first recording head 234*a* is configured to eject cyan (C) liquid drops. One of the nozzle arrays of the second recording head 234*b* is configured to eject magenta (M) liquid drops, and the other nozzle array of the second recording head 234*b* is configured to eject yellow (Y) liquid drops. Note that in this example, the recording head 234 has a two-head configuration for ejecting four color liquid drops; however, the recording head may have a one-head configuration having four nozzle arrays per head for ejecting four color liquid drops.

The ink tank 235 (i.e., ink tanks 235*a* and 235*b*) of the recording head 234 is supplied with respective colors of ink from respective colors of ink cartridges 210 from a supply unit via respective colors of supply tubes 236.

The serial-type image forming apparatus further includes a semicircular (sheet-feeding) roll 243 and a separation pad 244 made of a material having a high friction coefficient: and directed to face the sheet-feeding roller 243. The sheet-feeding roll 243 and the separation pad 244 are used as a sheet-feeding part for feeding sheets 242 accumulated on a sheet-accumulating part (platen) 241 of a sheet-feeding tray 202.

The sheet-feeding part composed of the sheet-feeding roller 243 and the separation pad 244 is configured to feed one sheet 242 at a time from the sheet-accumulating part 241, and the separation pad 244 is biased toward the sheet-feeding roller 243 side.

The serial-type image forming apparatus further includes a guide member 245 for guiding the sheet 242, a counter roller 246, a transfer guide member 247, an edge-pressing roll 249, and a presser member 248 in order to transfer the sheet 242 fed from the sheet-feeding part to a lower side of the recording head 234. The serial-type image forming apparatus also includes a transfer belt 251 to electrostatically attract the sheet 242 to transfer the sheet 242 to a position facing the recording head 234.

The transfer belt 251 is formed of an endless belt that is looped over a transfer roller 252 and a tension roller 253 so as to rotationally travel in a belt transferring direction (i.e., the sub-scanning direction). Further, the serial-type image forming apparatus further includes a charging roller 256 serving as a charging part configured to electrically charge a surface of the transfer belt 251. The charging roller 256 is disposed such that the charging roller 256 is brought into contact with a surface layer of the transfer belt 251 to be rotationally driven by the rotation of the transfer belt 251. The transfer belt 251 circumferentially travels in the belt transferring direction driven by the transfer roller 252 that is rotationally driven by a not-illustrated sub-scanning motor via the timing belt.

The serial-type image forming apparatus further includes a sheet-discharging part. The sheet-discharging part includes a separation claw 261 for separating the sheet 242 from the transfer belt 251, a sheet-discharge roller 262, a sheet-discharge spur 263, and a sheet-discharge tray 203 disposed at a lower side of the sheet-discharge roller 262.

The serial-type image forming apparatus further includes a duplex-printing unit 271 detachably attached at the back of the main body of the serial-type image forming apparatus. The duplex-printing unit 271 captures the sheet 242 rotationally transferred in a reverse direction of the transfer belt 251, reverses the sheet 242, and then feeds the reversed sheet 242 between the counter roller 246 and the transfer belt 251. The serial-type image forming apparatus further includes a manual bypass tray 272 on top of the duplex-printing unit 271

The serial-type image forming apparatus further includes a maintenance-restoration mechanism 281 serving as a head maintenance-restoration device including a restoration unit for maintaining and restoring the nozzle states of the recording head 234 in a non-printing region at one side of the carriage 233 in the carriage main-scanning direction. The maintenance-restoration mechanism 281 includes cap members 282*a* to 282*b* (hereinafter called "caps 282*a* to 282*b*" or simply called a "cap 282" as a generic name for the cap members 282*a* to 282*b*) for capping the respective nozzle faces of the liquid-jet recording head 234, a wiper blade 283 serving as a wiper blade member for wiping the nozzle faces and a discharged non-printing ink receiver 284 for receiving non-printing ink discharged from the liquid-jet head 284 when the thickened recording liquid is discharged as non-printing ink, due to its failure to function as the recording liquid.

The serial-type image forming apparatus further includes a non-printing ink receiver 288 in a non-printing region at the other side of the carriage 233 in the carriage main-scanning direction so as to receive the non-printing ink when the recording liquid is thickened and the thickened recording liquid is thus discharged. The non-printing ink receiver 288 includes an opening 289 along the nozzle array direction of the recording head 234.

In the image forming apparatus having the above configuration, the top sheet 242 is separated from the others in the sheet-feeding tray 202, the sheet 242 is disposed approximately vertically to be guided by the guide member 245, the sheet 242 is sandwiched between the transfer belt 251 and the counter roller 246 to be transferred, the edge of the sheet 242 is guided by the transfer guide member 247, and pressed against the transfer belt 251 by the edge-pressing roll 249, and by then the transfer direction of the sheet 242 is changed by approximately 90 degrees.

In this state, voltages are alternately applied to the charging roller 256 to repeatedly output positive and negative charges, such that the transfer belt 251 is charged with alternate charge voltage patterns corresponding to the charging roller 256. That is, the transfer belt 251 is charged such that the transfer belt 251 includes alternately disposed positive and negative charged bands having predetermined widths in the sub-scanning direction (i.e., a circumferential traveling direction of the transfer belt 251). When the sheet 242 is fed onto the transfer belt 251 that is alternately charged with positive and negative charge voltage patterns, the sheet 242 is electrostatically attracted by the transfer belt 251. The sheet 242 attracted to the transfer belt 251 is then transferred in the sub-scanning direction by circumferential traveling of the transfer belt 251.

The recording head 234 is driven based on image signals while the carriage 233 is moved such that the recording head 234 ejects ink drops onto the stationary sheet 242, thereby recording one line with the ejected ink drops. The sheet 242 is then transferred by a predetermined amount, and a next line is subsequently recorded on the sheet 242 with next ejected ink drops. The recording operation is terminated when a signal indicates that a rear end of the sheet 242 has reached a recording region. The sheet 242 is discharged onto the sheet-discharge tray 203.

Since the serial-type image forming apparatus includes the liquid-jet recording head according to the embodiments as the recording head, high-definition images may be stably formed.

Note that in the present application, a material of the "sheet" is not limited to paper, but may be an overhead projector (OHP) film, cloth, glass, and a substrate, to which ink drops or other liquids are attachable. Examples of such materials for the sheet may be called a "recording medium subject to being recorded on", a "recording medium", "recording paper", and a "recording sheet". Further, the terms "image forming", "recording", "printing", and "copying" may be used as synonyms.

In addition, the term an "image forming apparatus" indicates an apparatus that forms an image onto media such as paper, string, fiber, fabric, leather, metal, plastic, glass, wood, and ceramics by discharging liquid onto such media. Moreover, the term "forming an image" or "image formation" not only indicates providing an image having some kind of meaning onto the media such as characters and symbols, but also indicates an image without having any meaning such as patterns (i.e., by simply discharging ink drops onto the media).

Further, the term"ink" is not specifically limited to those generally called "ink", but may include a generically called "liquid" capable of forming an image, such as a recording liquid, a fixing liquid, and a liquid. The term "ink" may further include DNA specimens, resist, a patterning material, resin, and the like.

Moreover, the "image" is not limited to a two-dimensional image, but may include an image applied to a three-dimensionally formed object, or an image applied to a three-dimensional image formed of a molded object.

Further, the term "image forming apparatus" may include both a "serial-type image forming apparatus" and a "line-type image forming apparatus" unless otherwise specified.

According to the embodiments disclosed above, liquid drop ejecting properties of the liquid-jet head for use in the image forming apparatus having the image forming apparatus may be stabilized while the liquid-jet head and the image forming apparatus may be reduced in size.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-061640 filed on Mar. 19, 2012, the entire contents of which are hereby incorporated herein by reference.

What is claimed is:

1. A liquid-jet head comprising:

a channel plate forming an individual liquid chamber in communication with nozzles configured to eject liquid drops;

a wall surface member forming al surface of the individual liquid chamber; and a drive unit disposed on the wall surface member side and configured to generate a pressure applied to a drive region inside the individual liquid chamber, wherein a fluid resistance part is formed by disposing an island part in a liquid supply channel configured to supply a liquid to the individual liquid channel, and the island part includes a gradient part on the channel plate side, at least a part of the gradient part being formed such that the part of the gradient part faces the drive region inside the individual liquid chamber, wherein the wall surface member is a diaphragm member and the drive unit is an electromechanical transducer element configured to displace an oscillating region of the diaphragm member, and wherein at least a part of the gradient part is configured to face a coupling part between the electromechanical transducer element and the diaphragm member.

2. The liquid-jet head as claimed in claim 1, wherein a slope of the gradient part of the island part is configured to change at least in two phases in a cross section thereof along a liquid flowing direction.

3. The liquid-jet head as claimed in claim 2, wherein the gradient part includes a steep slope on the fluid resistance part side.

4. The liquid-jet head as claimed in claim 1, wherein at least the gradient part is integrally formed with the channel plate.

5. A liquid-jet head comprising:

a channel plate forming an individual liquid chamber in communication with nozzles configured to eject liquid drops;

a wall surface member forming a wall surface of the individual liquid chamber; and a drive unit disposed on the wall surface member side and configured to generate a pressure applied to a drive region inside the individual liquid chamber, wherein a fluid resistance part is formed by disposing an island part in a liquid supply channel configured to supply a liquid to the individual liquid channel, and the island part includes a gradient part on the channel plate side, at least a part of the gradient part being formed such that the part of the gradient part faces the drive region inside the individual liquid chamber, and wherein the channel plate is formed of a silicon substrate, and an end part of the island part in a liquid flowing direction includes a (1 1 1) crystal orientation, a first crystal orientation and a second crystal orientation that continue into and are in contact with the (1 1 1) crystal orientation, and a third crystal orientation differing from the (1 1 1) crystal orientation at continues into and is in contact with the first crystal orientation and the second crystal orientation.

6. An image forming apparatus comprising the liquid-jet head as claimed in claim 1.

7. An image forming apparatus comprising the liquid-jet head as claimed in claim 5.

8. The liquid-jet head as claimed in claim 5, wherein a slope of the gradient part of the island part is configured to change at least in two phases in a cross section thereof along a liquid flowing direction.

9. The liquid-jet head as claimed in claim 8, wherein the gradient part includes a steep slope on the fluid resistance part side.

10. The liquid-jet head as claimed in claim 5, wherein at least the gradient part is integrally formed with the channel plate.

11. The liquid-jet head as claimed in claim 5, wherein the wall surface member is a diaphragm member, and the drive unit is an electromechanical transducer element configured to displace an oscillating region of the diaphragm member.

12. The liquid-jet head as claimed in claim 1, wherein the channel plate is formed of a silicon substrate, and an end part of the island part in a liquid flowing direction includes a (1 1 1) crystal orientation, a first crystal orientation and a second crystal orientation that continue into and are in contact with the (1 1 1) crystal orientation, and a third crystal orientation differing from the (1 1 1) crystal orientation that continues into and is in contact with the first crystal orientation and the second crystal orientation.

* * * * *